United States Patent [19]

Rotondi et al.

[11] 4,340,989

[45] Jul. 27, 1982

[54] CLEANING SYSTEM FOR CHIMNEYS

[76] Inventors: Frank A. Rotondi, Dore Hill Rd., Box 288, Athens, Me. 04912; Howard W. Salley, P.O. Box 406, Pittsfield, Me. 04967

[21] Appl. No.: 227,318

[22] Filed: Jan. 22, 1981

[51] Int. Cl.[3] ..... F23J 3/00

[52] U.S. Cl. ..... 15/249; 15/163

[58] Field of Search ..... 15/163, 243, 249

[56] References Cited

U.S. PATENT DOCUMENTS

| | | | |
|---|---|---|---|
| 156,178 | 10/1874 | Schnautz . | |
| 282,775 | 8/1883 | Resor . | |
| 363,893 | 5/1887 | Harvey | 15/163 |
| 598,672 | 2/1898 | Dunn . | |
| 614,874 | 11/1898 | Lefebvre et al. . | |
| 764,265 | 7/1904 | Wensauer | 15/249 |
| 854,101 | 5/1907 | Miller . | |
| 1,069,826 | 8/1913 | Smith . | |
| 1,070,662 | 8/1913 | Bedford et al. . | |
| 1,297,090 | 3/1919 | Campbell et al. . | |
| 1,683,379 | 9/1928 | Bickford . | |
| 4,138,758 | 2/1979 | Dodge et al. | 15/243 |
| 4,208,757 | 6/1980 | Baugh et al. | 15/243 |

FOREIGN PATENT DOCUMENTS

| | | | |
|---|---|---|---|
| 566520 | 9/1975 | Switzerland | 15/243 |

*Primary Examiner*—Robert L. Bleutge

*Attorney, Agent, or Firm*—James A. Wong

[57] ABSTRACT

A readily removable cleaning system for a chimney comprising in combination adjacent the top of a chimney a pair of bracket members each having a generally horizontally extending center portion disposed on an upper edge surface of the chimney oppositely from the upper edge surface on which the other center portion is disposed, a generally vertically extending upwardly directed inner portion with an aperture, and a generally vertically extending downwardly directed outer portion embracing an outer chimney wall surface oppositely from that embraced by the other downwardly directed outer portion; a strap or like element extending around the downwardly directed portions of both bracket members and the outside of the chimney to removably secure the bracket members to the chimney; an upper threaded rod and a lower threaded rod supporting a pulley system around which a chain or like member with a brush is supported for up and down movement. The effective length of the upper and lower rods are adjustable and the locations of the pulley system and cleaning brush are adjustable along the lengths of both the upper and the lower support rods.

4 Claims, 4 Drawing Figures

CLEANING SYSTEM FOR CHIMNEYS

BACKGROUND OF THE INVENTION

1. Field of the Invention

This invention relates to a cleaning system for chimneys such as might be found with art in class 15, subclasses 162, 163, 242, 243 and/or 249 of the United States patent classification system.

2. Description of the Prior Art

Exemplifying some of the most pertinent known prior art chimney cleaning systems are U.S. Pat. Nos. 363,893 (Harvey); 764,265 (Wensauer); and 4,138,758 (Dodge et al). According to the prior art, chimney cleaning systems generally comprise a traveling cleaning element installed in a chimney with a pulley and chain or cable to facilitate movement thereof up and down the chimney during cleaning operations. In both the Harvey and the Dodge et al cleaning systems, a pulley block is mounted at the top of the chimney with a chain or cable extending therearound and a cleaning element attached thereon for up and down movement to clean the chimney. A lower guide pulley is not provided by Dodge et al to control lateral force components on the chain or cable. In Harvey a thimble is installed to provide a modicum of lateral control of the cable. In Wensauer, a lower pulley with an operating crank is installed in the chimney on a mounting bracket which appears to be limited in width to that of the chimney.

SUMMARY OF THE INVENTION

The present invention constitutes a new and improved cleaning system for chimneys which is readily installed in and removable from a chimney.

An object of the present invention is to provide a new and improved cleaning system for chimneys which will readily fit and operate well in any of several chimneys of different transverse or lateral dimensions.

Another object of the present invention is to provide a new and improved cleaning system for chimneys which includes an upper pulley unit to facilitate travel and return of a cleaning element, a lower pulley unit to cooperate with the upper unit and to function as a guide.

Still another object of the present invention is to provide a new and improved chimney cleaning system with means for adjusting the location of the pulley units, the cleaning element, and the chain or cable transversely to or from two opposite walls in a chimney.

Yet another object of the present invention is to provide a new and improved chimney cleaning system wherein the mounting member for the lower pulley unit is variable in length to conform to the distance between opposite walls of a chimney.

Other objects and advantages of the present invention will be apparent from the following description taken in conjunction with the accompanying drawings.

BRIEF DESCRIPTION OF THE DRAWINGS

The present invention will be readily understood by the reader on review of the accompanying drawings of which.

DETAILED DESCRIPTION OF THE PREFERRED EMBODIMENT

Figure 1:
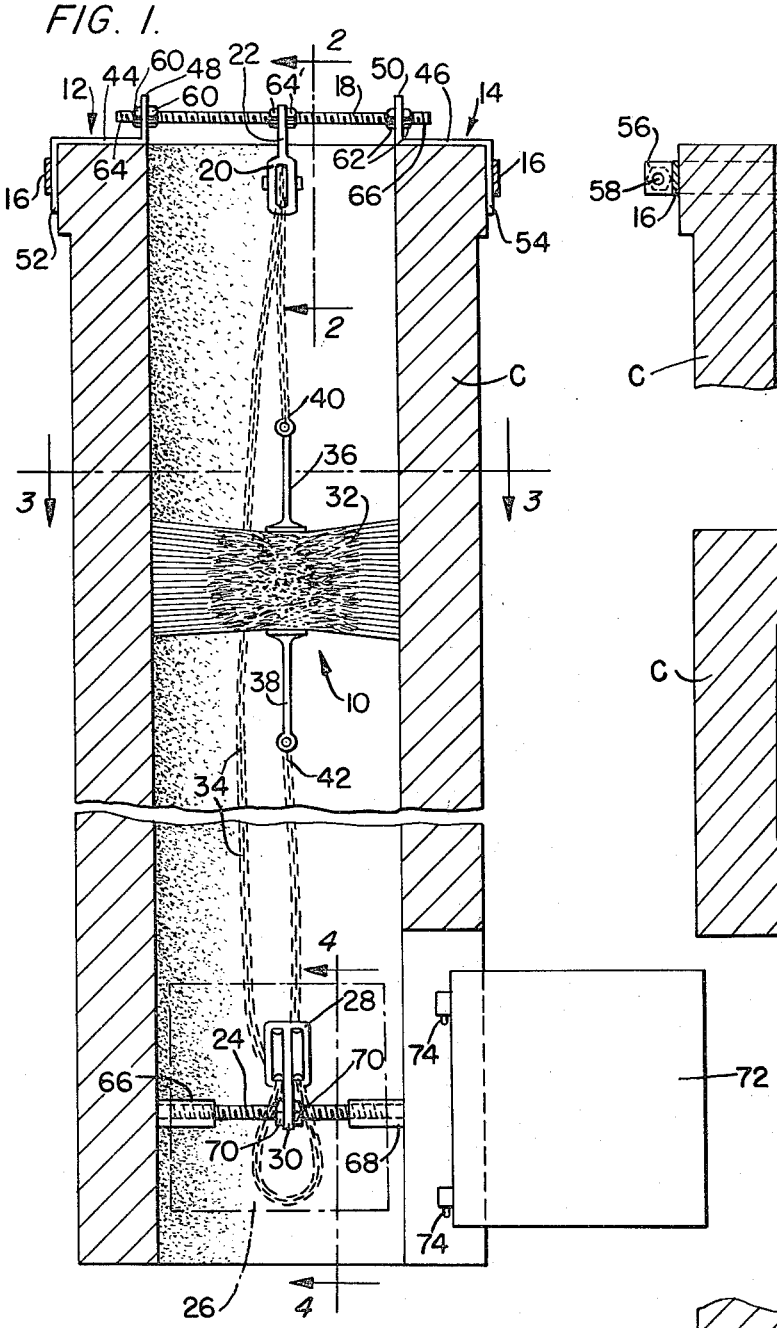
FIG. 1 represents a vertical sectional view through a chimney with the chimney cleaning system according to the present invention installed therein and portions broken away.

Referring now in detail to FIGS. 1-4, the reader will readily appreciate that the disclosed invention herein relates to a cleaning system 10 for a chimney C which may be readily installed and removed from any of several chimneys of different lateral dimensions. As may be clearly seen in FIG. 1, the chimney cleaning system 10 according to the present invention comprises in combination a pair of bracket members 12, 14 removably secured at the top of chimney C by strap 16; an upper support rod 18 with an upper pulley block unit 20 extending down into chimney C from a mounting flange 22; a lower support rod 24 extending within chimney C, below upper support rod 18 generally parallel thereto, and adjacent to a cleanout opening 26; a lower pulley block unit 28 extending upwardly from a mounting plate 30 secured on lower support rod 24; a cleaning element 32 disposed within chimney C between upper and lower pulley block units 20 and 28; a chain, cable, or like member 34 extending through both the upper and the lower pulley block units 20 and 28, respectively; and upwardly and downwardly directed connecting links 36 and 38 extending from cleaning element 32 and connecting opposite ends 40, 42 of chain, cable, or like member 34 to cleaning element 32. Each of the bracket members 12, 14 includes a generally horizontally extending center portion 44, 46, which when installed are disposed on an upper edge surface of the chimney C oppositely from the upper edge surface on which the center portion of the other bracket member is disposed; a generally vertically extending upwardly directed inner portion 48, 50 with an aperture, and a generally vertically extending downwardly directed outer portion 52, 54 embracing an outer chimney wall surface oppositely from that embraced by the downwardly directed outer portion of the other bracket member.

Figure 2:
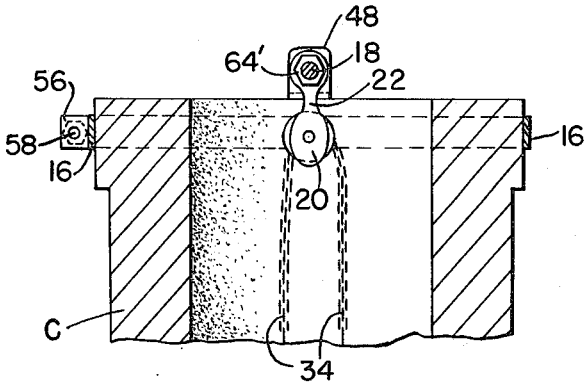
FIG. 2 represents a view taken along the plane 2—2, looking in the direction of the arrows in FIG. 1.
Figure 3:
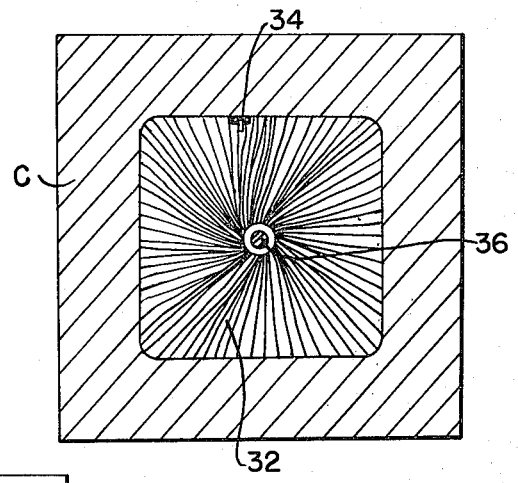
FIG. 3 represents a view taken along the plane 3—3, looking in the direction of the arrows in FIG. 1.
Figure 4:
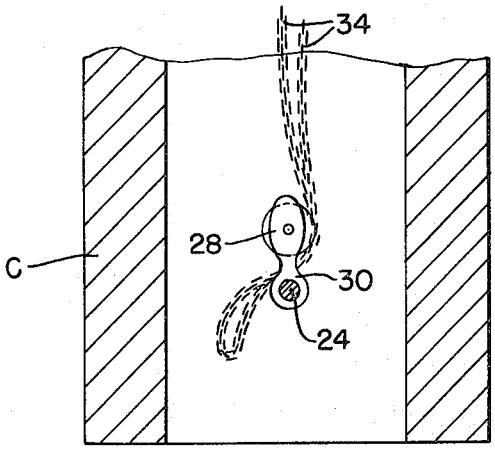
FIG. 4 represents a view taken along the plane 4—4, looking in the direction of the arrows in FIG. 1.

Strap 16 extends around the downwardly directed portions 52, 54 of both bracket members 12, 14 and the outside of the chimney C to removably secure bracket members 12, 14 to the chimney C. Opposite ends 56, one of which is shown in FIG. 2, of strap 16 may be bent outwardly and drawn together by a bolt 58. Upper rod 18 is threaded and extends outside of and across the top of the chimney C and through the apertures of inner portions 48, 50 of bracket members 12, 14, respectively. A pair of nuts 60, 62 are threaded on or adjacent opposite ends 64, 66 of upper threaded rod 18. One nut of each pair 60, 62 is outside one of the upwardly directed inner portions 48, 50 and the other nut of each of pair 60, 62 is inside one of the upwardly directed inner portions 48, 50 to adjustably secure upper rod 18 in position.

Upper pulley block unit 20 comprises a single sheave rotatably secured within a fork or yoke portion extending down into chimney C from mounting flange 22 suspended from upper support rod 18. An additional pair of nuts 64', 64', one each of which is threaded on upper rod 18 on opposite sides of mounting flange 22, are provided to cooperatively adjustably secure pulley block unit 20 in position. A pair of abutment members 66, 68 are threadedly secured on opposite ends of lower rod 26, which is also threaded to effect adjustable clamping pressure relationship against opposite inner wall surfaces of the chimney C. Lower pulley block unit 28 is a double pulley unit and mounting plate 30 from which it extends upwardly are adjustably secured on lower rod 24. A further pair of nuts 70 are in threaded relationship with lower rod 24 against opposite sides of mounting plate 30.

Cleaning element 32 is in the form of a brush with connecting links 36, 38 extending upwardly and downwardly therefrom into connection with chain 34 having a first end 40 connected to upwardly directed link 36, extending up from upwardly directed link 36 to the upper single pulley unit 20, through a front side thereof, over the upper pulley to a back side of the upper pulley, down to the lower double pulley unit 28, in the back of the lower unit 28, under and partially around one of the lower pulley members, up the front of the lower block unit 28, under the other lower pulley member, and out the back of the lower block unit 28, and up to and connected to the downwardly directed connecting link 38, whereby brush 32 may be pulled up and down the chimney C to clean it.

Installation of cleaning system 10 into chimney C may be accomplished very simply by threading end 64 of support rod 18 onto inner nut 60, inserting end 64 of support rod 18 through the aperture of portion 48 of bracket member 12, threading outer nut 60 onto end 64 of rod 18, inserting rod 18 through mounting flange 22 of pulley block unit 20 with nuts 64', 64' threaded on rod 18 on opposite sides of flange 22, and apply nuts 62, 62 and portion 50 of bracket member 14 on end 66 of rod 18 in mirror image to corresponding elements on end 64 of shaft 18. Cleaning system 10 may then be adjustably secured on chimney C by seating center portions 44, 46 on the upper edge surfaces of chimney C as shown in FIG. 1 and secured thereto by applying strap 16 therearound and tightening bolt 58 to draw outwardly bent ends 56 of strap 16 together. Upper pulley block unit 20, chain 34, brush 32, lower pulley block unit 28, lower support rod 24, abutment members 66, 68, and nuts 70, 70 may then be lowered into chimney C, after which nuts 64', 64' will be threaded to locate upper pulley unit 20 in the correct or desired position and then tightened. Nuts 60, 60 and 62, 62 will then be tightened against upwardly directed inner portions 48 and 50, respectively, to provide a stable assembly between upper support rod 18 and bracket members 12, 14. Abutment members 66, 68 may then be rotated outwardly from opposite ends of lower support rod 24 to apply clamping pressure against opposite inner walls of chimney C with care being given to direct lower pulley block unit 28 upwardly, as may be seen in FIGS. 1 and 4, and to seeing to it that excess slack be removed from between chain 34 and each of pulley block units 20 and 28 to ensure facility and efficiency of movement of chain 34. Nuts 70, 70 may then be rotated to locate lower pulley block unit 28 in the desired position along lower support rod, after which nuts 70, 70 are tightened to secure lower pulley block unit in an upwardly directed attitude.

Access to the lower loop of chain 34 may be attained by opening door 72 supported on hinges 72 to uncover cleanout opening 26. Brush 32 is pulled upwardly and downwardly by first pulling on one portion of chain 34 extending below one pulley of unit 28 and then on the portion of chain 34 extending below the other pulley of unit 28 to clean chimney C.

From the foregoing description, it may be readily appreciated that the disclosed chimney cleaning system 10 comprises a minimum of parts, requiring no holes to be drilled into the chimney and is thus quickly and easily installed and removed. Further, it is readily seen that cleaning system is easily adjustable across the width of chimney C both with respect to upper pulley block unit 20 and to lower pulley block unit 28 and hence adaptable to chimneys of any of several different lateral dimensions. Moreover, the effective length of upper support rod 18 may be extended or shortened by rotary adjustment of the clamping positions of nuts 60, 60 and 62, 62 on the respective opposite ends 64, 66 of upper support rod 18. Similarly, the effective length of lower support rod 24 may be extended or shortened by rotary adjustment of either or both abutment members 66, 68 which are threaded on opposite ends of lower support rod 24.

It will be obvious to those skilled in the art that various changes may be made without departing from the scope of the invention and the invention is not to be considered limited to what is shown in the drawings and described in the specification.

What is claimed is:

1. A readily removable cleaning system in a chimney comprising in combination:

a. adjacent the top of a chimney a pair of bracket members each having a generally horizontally extending center portion disposed on an upper edge surface of the chimney oppositely from the upper edge surface on which the other center portion is disposed, a generally vertically extending upwardly directed inner portion with an aperture, and a generally vertically extending downwardly directed outer portion embracing an outer chimney wall surface oppositely from that embraced by the other downwardly directed outer portion;

b. means extending around the downwardly directed portions of both of said bracket members and the outside of the chimney to removably secure said bracket members to the chimney;

c. an upper threaded rod extending outside of and across the top of the chimney and through the apertures of said inner portions of said bracket members with means disposed adjacent opposite ends of said upper rod adjustably securing said upper rod on opposite sides of said upwardly directed inner portions whereby the effective length of said upper rod may be adjusted to secure said upper rod in position;

d. an upper single pulley block unit extending down into the chimney from a mounting flange suspended on said upper threaded rod and a pair of nuts, one each of which is threaded on said upper rod on opposite sides of said mounting flange to cooperatively adjustably secure said pulley block unit in position;

e. a lower threaded rod extending within the chimney, below said upper threaded rod generally parallel thereto, and adjacent to a chimney cleanout opening;

f. abutment members threadedly secured on opposite ends of said lower threaded rod and in pressure relationship against opposite inner wall surfaces of the chimney;

g. a lower double pulley block unit extending upwardly from a mounting plate adjustably secured on said lower threaded rod with a further pair of nuts threaded on said lower threaded rod in clamping relationship against opposite sides of said mounting plate;

h. chimney cleaning means disposed within the chimney between said upper and lower pulley block units, said cleaning means including upwardly and downwardly directed connecting links; and i. a chain, cable, or like member having a first end connected to said upwardly directed link, extending up from said upwardly directed link to the upper single pulley, through a front side, over the upper pulley to a back side of the upper pulley, down to the lower double pulley unit, in the back of the lower unit, under and partially around one of the lower pulley members, up the front of the lower block, under the other lower pulley member, and out the back of the lower block, and up to and connected to the downwardly directed connecting link, whereby said brush may be pulled up and down the chimney to clean it.

2. The cleaning system as defined in claim 1, wherein said means adjustably securing said upper rod on opposite sides of said upwardly directed inner portions comprise two additional pairs of nuts wherein one nut of each of said additional pairs of nuts is outside one of said upwardly directed inner portion and the other nut of each of said additional pairs of nuts is inside one of said upwardly directed inner portion, and each of said additional pairs of nuts being in clamping relationship against the upwardly directed inner portion disposed therebetween.

3. The cleaning system as defined in claim 1 or 2, wherein said chimney cleaning means is in the form of a brush.

4. The cleaning system as defined in claim 3, wherein said means to removably secure said bracket members to the chimney comprises a strap with opposite ends including elements cooperating to draw said opposite strap ends together.

* * * * *